US005899560A

United States Patent [19]

Byers

[11] Patent Number: 5,899,560

[45] Date of Patent: May 4, 1999

[54] LIQUID SLURRY AGITATION APPARATUS

[75] Inventor: Stuart David Byers, Bradford, Canada

[73] Assignee: Alstor Canada Inc., Bolton, Canada

[21] Appl. No.: 09/026,656

[22] Filed: Feb. 20, 1998

[51] Int. Cl.[6] ..... B01F 5/04; B01F 15/02

[52] U.S. Cl. ..... 366/137; 366/167.2; 239/263; 239/263.3

[58] Field of Search ..... 366/136, 137, 366/159.1, 167.1, 167.2, 182.2; 239/127, 142, 227, 263, 263.2, 263.3

[56] References Cited

U.S. PATENT DOCUMENTS

| | | | |
|---|---|---|---|
| 1,073,878 | 9/1913 | Trent | 366/137 |
| 1,156,946 | 10/1915 | Vandercook | 366/137 |
| 1,240,904 | 9/1917 | Trent | 366/136 |
| 2,661,241 | 12/1953 | Veneziano | 239/227 |
| 3,136,828 | 6/1964 | Rideout | 239/263.2 |
| 3,512,713 | 5/1970 | Carlyon, Jr. | 366/136 |
| 3,944,119 | 3/1976 | Egee | 366/136 |
| 4,207,920 | 6/1980 | Weterhoff . | |
| 4,332,484 | 6/1982 | Peters | 366/137 |
| 4,394,966 | 7/1983 | Snyder et al. | 239/127 |
| 4,410,279 | 10/1983 | Howden et al. | 366/262 |
| 4,416,549 | 11/1983 | Kretschmer | 366/190 |
| 4,512,665 | 4/1985 | Cline et al. . | |
| 4,893,937 | 1/1990 | Braun | 366/136 |
| 5,458,414 | 10/1995 | Crump et al. | 366/137 |
| 5,558,434 | 9/1996 | Hamada et al. | 366/137 |
| 5,564,825 | 10/1996 | Burt | 239/142 |
| 5,658,076 | 8/1997 | Crump et al. | 366/270 |
| 5,810,473 | 9/1998 | Manabe et al. | 239/227 |

FOREIGN PATENT DOCUMENTS

| | | | |
|---|---|---|---|
| 53-21412 | 2/1978 | Japan | 366/136 |

OTHER PUBLICATIONS

A.O. Smith Harvestore Products Inc.; "A Better Idea for Sludge Mixing and Storage", 1992.

*Primary Examiner*—Charles E. Cooley
*Attorney, Agent, or Firm*—Donald E. Hewson

[57] ABSTRACT

A slurry agitation apparatus for selectively agitating slurry temporarily stored in the interior of a storage tank, which slurry contains heavier-than-liquid solids and is at least somewhat pumpable, comprises a slurry circuit having connected together in seriatim, and in fluid communication through pipes one with the next, an outlet disposed in the sump pit in fluid communication with the interior of the storage tank to permit egress of the slurry therefrom, a flow control valve, a selectively controllable slurry pump, and a discharge nozzle. The discharge nozzle is rotatably mounted in surrounding sealed relation on a substantially vertical spigot securely mounted on the concrete foundation of the storage tank, for selective rotation of the discharge nozzle about a substantially vertical main axis, and has a spout portion in fluid communication with the interior of the storage tank and oriented to emit the slurry from the spout portion as a generally horizontally directed discharge. A hydraulic circuit has connected together in seriatim, and in fluid communication through hydraulic piping one with the next, a selectively controllable hydraulic pump and a selectively operable hydraulic motor mounted within an enclosure located in the storage tank on the foundation, so as to be engaged in driving relation with the discharge nozzle. The discharge nozzle is selectively rotatable about its substantially vertical main axis. When slurry is being discharged from the discharge nozzle, there is a corresponding change in the horizontal direction of the discharge of slurry. The discharge nozzle may be selectively rotated even though a discharge operation is not being carried out; and the discharge nozzle may be stationary for a selected period of time during a discharge operation.

20 Claims, 3 Drawing Sheets

LIQUID SLURRY AGITATION APPARATUS

FIELD OF THE INVENTION

This invention relates to a slurry agitation apparatus for selectively agitating slurry temporarily stored in the interior of a storage tank, and more particularly to a slurry agitation apparatus having a discharge nozzle that is automatically rotated when slurry is being discharged from the discharge nozzle. The discharge nozzle is also selectively rotatable.

BACKGROUND OF THE INVENTION

It is common to store slurry, such as manure slurry on farms or effluent slurry in municipal plants, among other types, for later use or for treatment, as appropriate. Various types of slurry are typically stored in large storage tanks of perhaps thirty feet to eighty feet in diameter, or even smaller or larger, both open-top and covered-top types. Slurry is typically added to or removed from a storage tank on an intermittent basis, and is ultimately pumped from the storage tank, for transporting to another site or for use.

Slurry might remain stored in a storage tank for periods of weeks or even months at a time, and might not be added to or removed from for several days or even weeks at a time. Accordingly, it is possible for the slurry to remain immobile for several days or even weeks at a time, unless purposely agitated. Leaving slurry unagitated and immobile for days or weeks at a time can cause significant unwanted problems. The slurry tends to congeal and coagulate, and generally become lumpy, and therefore becomes very difficult to pump. Ultimately the slurry starts to solidify, which is highly undesirable, and the solids in the slurry will settle out in time, so that the lower region of the stored slurry becomes a very dense and highly viscous sludge, while the upper region of the slurry reverts to a consistency more or less like that of water.

In many instances, it is undesirable to add water to slurry to preclude it from becoming lumpy or hardening, as the addition of water tends to upset the chemical balance of the slurry. The chemical balance of the slurry is important in various applications, such as if it is to be used as fertilizer on farms. In spite of this fact, it is well known in the prior art to add water to slurry to augment agitation of the slurry.

Moreover, although it is generally undesirable to agitate slurry on an overall continuous basis because of the tremendous energy and effort required to do so, it is necessary to physically agitate slurry at least occasionally, to keep it free-flowing and liquid. Therefore, it is common to agitate slurry just before it is pumped out of its tank, perhaps immediately before or one or two days before. It is also a practice to periodically agitate slurry, so as to avoid problems as noted above; or to agitate the slurry before more slurry is added to it, so as to ensure that the stored slurry is more or less homogenous, at least for a period of time before settling once again occurs.

Since slurry is agitated on an occasional basis, it is preferable to agitate slurry in a continually moving manner in order that substantially the entire volume of slurry in a storage tank can be agitated, so as to be properly mixed and liquified. However, this is not accomplished by any apparatus in the prior art.

It is an object of the present invention to provide a slurry agitation apparatus where slurry is agitated on an occasional basis, in a continually moving manner.

DESCRIPTION OF THE PRIOR ART

U.S. Pat. No. 4,332,484 issued Jun. 1, 1982 to PETERS, discloses an agitation system for manure slurry wherein a gate valve is located in the floor of a storage tank, which gate valve can be opened from the outside of the tank by a valve in order to draw manure slurry from the inside of the tank through a piping system. A pump assembly draws the slurry out through the piping system and pumps the slurry back into the tank through a valved pipe to a high pressure agitator nozzle that may be selectively rotated or directed by means of a hand operable gear system having a hand crank disposed externally of the storage tank. The main disadvantage of this system is that it requires a considerable amount of effort to manually turn the agitator nozzle. Further, it has been found that, if the slurry has already become somewhat thick, it is extremely difficult to turn the agitator nozzle. Also, it is quite difficult to have the amount of flow of the slurry being pumped and the speed of rotation of the agitator nozzle coincide one with the other.

It is well known in the field, that it is very common where slurry storage tanks having agitation equipment similar to that in the above described patent are to be found, especially in agricultural installations, to defer the agitation of the slurry until it is too late and the slurry cannot be pumped. In extreme cases, it has been necessary to partially disassemble storage tanks and remove the thickened slurry deposited therein using costly specialized equipment, such as appropriately outfitted tractors, back-hoes, and the like.

U.S. Pat. No. 4,416,549 issued Nov. 22, 1983 to KRETSCHMER discloses an apparatus for agitating and pumping a liquid slurry wherein a pump is disposed within a storage tank, driven by a motor above the storage tank, and draws slurry from its immediate vicinity and pumps the slurry immediately back out again a short distance from its intake. The pump is manually rotatable, without the aid of mechanical advantage, so as to be aimed in one particular direction at a time, which leads to minimal agitation. The pump is also selectively elevatable by means of an electric winch.

U.S. Pat. No. 4,410,279 issued Oct. 18, 1983 to HOWDEN et al discloses an apparatus for agitating the contents of storage tanks, which apparatus is selectively raised and lowered into the slurry in the storage tank. An impeller draws in slurry through the bottom of the apparatus, which indrawn slurry is mixed with a flow of fresh water to thin the slurry so that it may flow more readily. The introduction of water into slurry is often highly undesirable since the overall chemistry of the slurry is changed somewhat, at least as to concentration.

U.S. Pat. No. 4,512,665 issued Apr. 23, 1985 to CLINE et al discloses an adjustable over-the-top agitator for a liquid manure tank wherein an external delivery pipe is in fluid communication with a pump that draws slurry from the interior of a storage tank. The discharge nozzle is horizontally swivelable, by manual operation, with no mechanical advantage, in order to spread the discharge of slurry over the top of the slurry in the storage tank, thereby breaking the crust. If the slurry in the storage tank was properly managed, such as by means of the present invention, there would be no necessity to use an elevated discharge nozzle to break the top crust of the slurry.

SUMMARY OF THE INVENTION

In accordance with one aspect of the present invention, there is provided a slurry agitation apparatus for selectively agitating slurry temporarily stored in the interior of a storage tank having a concrete foundation forming a floor and a perimeter wall disposed around the concrete foundation and extending upwardly from the concrete foundation. The concrete foundation and the perimeter wall together form an interior for receiving and retaining slurry therein. A sump pit is disposed in the concrete foundation and is open to the floor. The slurry contains heavier-than-liquid solids suspended therein, and is at least somewhat pumpable. The slurry agitation apparatus comprises a slurry circuit having connected together in seriatim, and in fluid communication through pipes one with the next: an outlet disposed in the sump pit in fluid communication with the interior of the storage tank to permit egress of the slurry therefrom; flow control valve means; selectively controllable slurry pump means; and a discharge nozzle. The discharge nozzle is rotatably mounted in surrounding sealed relation on a substantially vertical spigot securely mounted on the concrete foundation of the storage tank, for selective rotation of the discharge nozzle about a substantially vertical main axis, and has a spout portion in fluid communication with the interior of the storage tank and oriented to emit the slurry from the spout portion as a generally horizontally directed discharge. A hydraulic circuit is connected together in seriatim, and in fluid communication through hydraulic piping one with the next: selectively controllable hydraulic pump means; and selectively operable hydraulic motor means mounted within an enclosure located in the storage tank on the foundation, so as to be engaged in driving relation with the discharge nozzle to cause the selective rotation of the discharge nozzle about the substantially vertical main axis.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
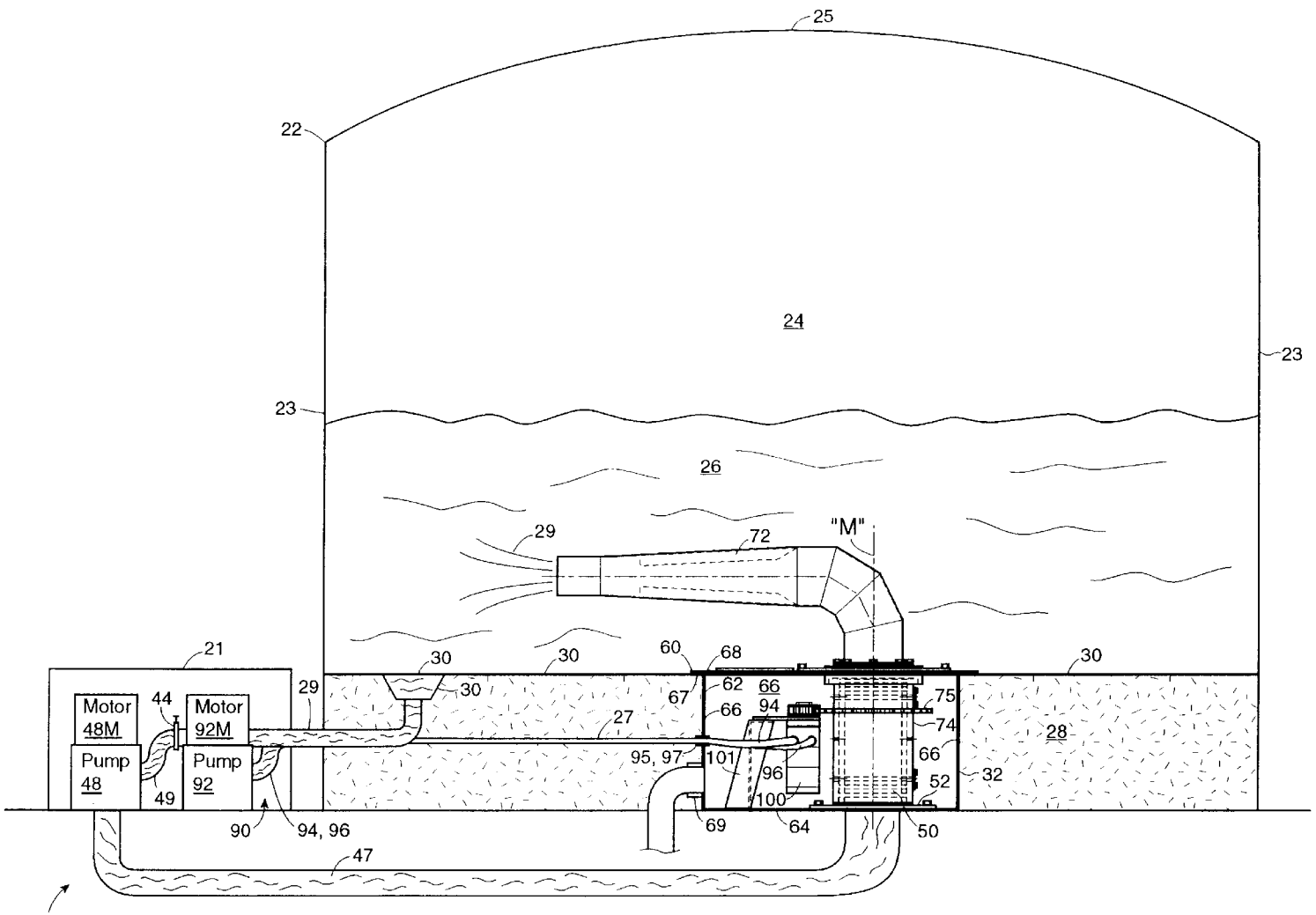
FIG. 1 is a sectional side elevational view of a preferred embodiment of the slurry agitation apparatus according to the present invention installed in a slurry storage tank.

Reference will now be made to FIGS. 1 through 6, which show the slurry agitation apparatus of the present invention, as indicated by the general reference numeral 20. The slurry agitation apparatus 20 is for selectively agitating slurry 26 temporarily stored in the interior 24 of a storage tank 22. The storage tank 22 typically has a concrete foundation 28 forming a floor 30, which concrete foundation 28 has an equipment retaining pit 32 and a sump pit 34 disposed therein. Both the equipment retaining pit 32 and the sump pit 34 are open to the floor 30, at least as formed; however, the equipment retaining pit 32 is closed off to the interior of the storage tank 22, as noted below. As can best be seen in FIG. 2, an enclosure 60 comprises an open-top bottom receptacle 62 having a bottom panel 64 and a four adjoined side panels 66 extending upwardly from the bottom panel 64 to terminate in a substantially horizontally oriented planar flange 67. One of the side panels 66 has a drain coupling 69 therein, which leads to a drain 31. A top panel 68 is removably secured to said substantially horizontally oriented planar flange 67, and is disposed within the equipment retaining pit 32. The planar flange 67 of the bottom receptacle 62 of the enclosure 60 is secured to the concrete foundation 28, thus closing off the equipment retaining pit 32. The top panel 68 is, in turn, secured to the planar flange 67 of the enclosure 60. The enclosure 60 is used to house and protect various equipment, as will be described in greater detail subsequently, and has a removable and replaceable access plate in the top thereof to permit access to equipment therein.

The storage tank 22 also comprises a perimeter wall 23—in this case, cylindrical—disposed around the concrete foundation 28 and extending upwardly from the concrete foundation 28. The perimeter wall 23 terminates in a roof 25, which roof 25 is preferably slightly domed shaped to cause the run-off of snow and rain. The concrete foundation 28, the perimeter wall 23, and the roof 25, together form an interior 24 for receiving and retaining slurry 26 therein. The slurry 26 typically contains heavier-than-liquid solids suspended therein, and may also contain lighter-than-liquid fibrous material, and is at least somewhat pumpable.

The slurry agitation apparatus 20 includes a slurry circuit, as indicated by the general reference numeral 40, having various components connected together in seriatim and in fluid communication one with the next through various pipes in the slurry circuit 40. The pipes are substantially buried in the concrete foundation 28, as will be discussed in greater detail subsequently. The slurry circuit 40 includes an outlet 42 disposed in the sump pit 34, which outlet 42 is in fluid communication with the interior 24 of the storage tank 22 to permit egress of the slurry 26 from the interior 24 of the storage tank 22. A flow control valve means 44, which is either an automatically operated or manually operated valve 44, is disposed exteriorly to the storage tank 22, preferably in a pump house 21, and is in fluid communication with the outlet 42 by means of a slurry return line 46 buried in the concrete foundation 28. A selectively controllable slurry pump means 48, preferably, but not necessarily, a bi-directional slurry pump 48, so that the slurry 26 may be pumped in either direction, as noted hereafter. The slurry pump 48 is also preferably a chopper pump in order to help break up any solids or semi-solids in the slurry 26. The slurry pump 48 may be driven by an electric motor 48*m*, or, in an agricultural setting, by a suitably connected tractor (not shown), or by any other suitable means. The slurry pump 48 is also disposed exteriorly to the storage tank 22, preferably in the pump house 21, and is in fluid communication with the flow control valve means 44 through a suitable pipe 49. A slurry supply line 47 buried in the concrete foundation 28 connects in fluid communication to the selectively controllable slurry pump 48 to a substantially vertical spigot 50 securely mounted on the concrete foundation 28 of the storage tank 22, within the enclosure 60.

Figure 4:
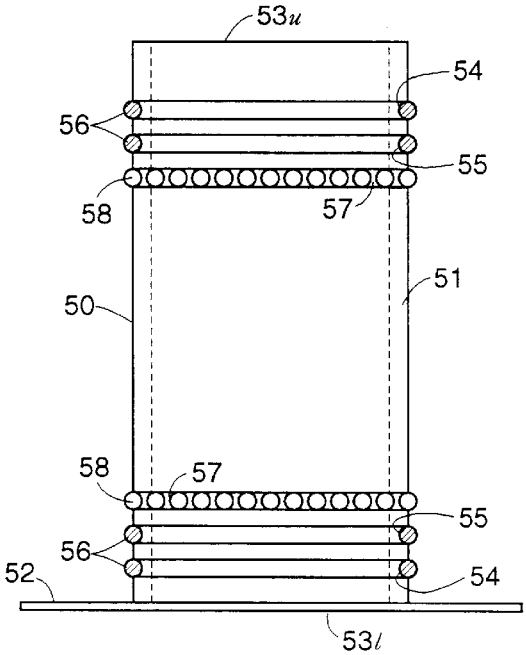
FIG. 4 is a side elevational view of a spigot used in the slurry agitation apparatus of FIG. 1.

As can be best seen in FIG. 4, the spigot 50 includes an annular base flange 52 that is secured by threaded fasteners (not shown) to the bottom panel of the enclosure 60. The spigot 50 is mounted on the concrete foundation 28 by means of the enclosure 60. The spigot 50 includes two pair of annular "O"-ring grooves 54,55 cut in its outer surface 51, with one pair of the "O"-ring grooves 54 being disposed one adjacent each of the upper and lower ends 53*u,* 53*l* of the spigot 50, and the second pair of "O"-ring grooves 55 disposed one adjacent each of the "O"-ring grooves 54 of the first pair. A co-operating "O"-ring 56 is seated in each of the "O"-ring grooves 54,55. The spigot 50 also includes a pair of annular ball bearing races 57 cut in its outer surface 51, disposed one annular ball bearing race 57 adjacent each of the upper and lower ends 53*u,* 53*l* of the spigot 50. A plurality of ball bearings 58 are seated in each of the ball bearing races 57.

A discharge nozzle, as indicated by the general reference numeral 70, comprises a substantially horizontally oriented spout portion 72 and a sleeve portion 74 secured one to the other so as to be in fluid communication one with the other. In this manner, the substantially horizontally oriented spout portion 72 is in fluid communication with the interior 24 of the storage tank 22. The sleeve portion 74 of the discharge nozzle 70 includes a pair of annular ball bearing races 76 cut in its inner surface, disposed one adjacent each of the upper and lower ends of the sleeve portion 74. Each ball bearing race 76 in the sleeve portion 74 is vertically aligned with a corresponding ball bearing race 57 in the spigot 50, thereby to receive a corresponding one of the pluralities of ball bearings 58 seated in each ball bearing race 57. As can best be seen in FIG. 5, two ports 78 having removable and replaceable covers 79 are included to permit insertion of the ball bearings 58 into the space between the sleeve portion 74 of the discharge nozzle 70 and the spigot 50 and for subsequent removal of the ball bearings 58, for maintenance purposes.

The sleeve portion 74 of the discharge nozzle 70 is disposed within the enclosure 60 and surrounds the substantially vertical spigot 50 in rotatable relation with the ball bearings 58 and the "O"-rings 56 disposed between the substantially vertical spigot 50 and the sleeve portion 74, as discussed above. In this manner, the discharge nozzle 70 is rotatably mounted in surrounding sealed relation on the substantially vertical spigot 50 for selective rotation of the discharge nozzle 70 about a substantially vertical main axis "M".

Figure 5:
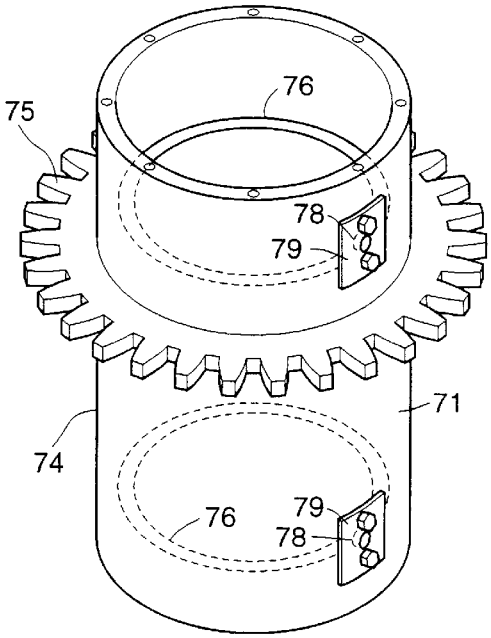
FIG. 5 is a perspective view of a sleeve portion of the rotatable discharge nozzle of the slurry agitation apparatus of FIG. 1.

As can best be seen in FIG. 5, the sleeve portion 74 further comprises a peripherally disposed annular sprocket 75 secured to its outer surface 71 by any suitable means, such as welding, the purpose of which peripherally disposed annular sprocket 75 will be discussed in greater detail subsequently.

Figure 2:
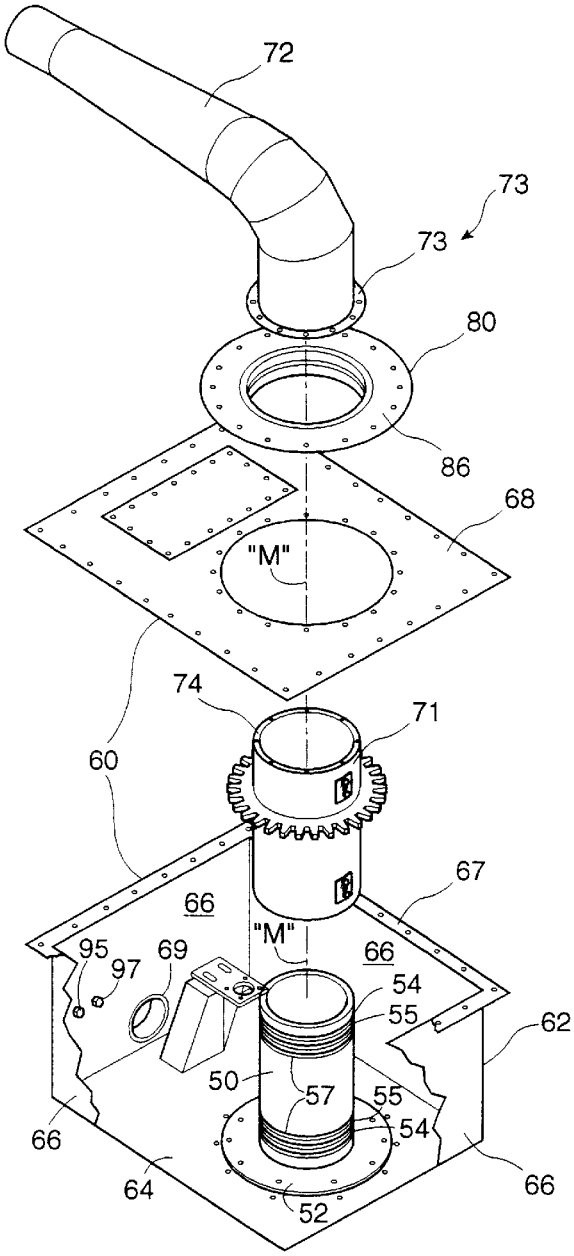
FIG. 2 is an exploded perspective view of the slurry agitation apparatus of FIG. 1.
Figure 3:
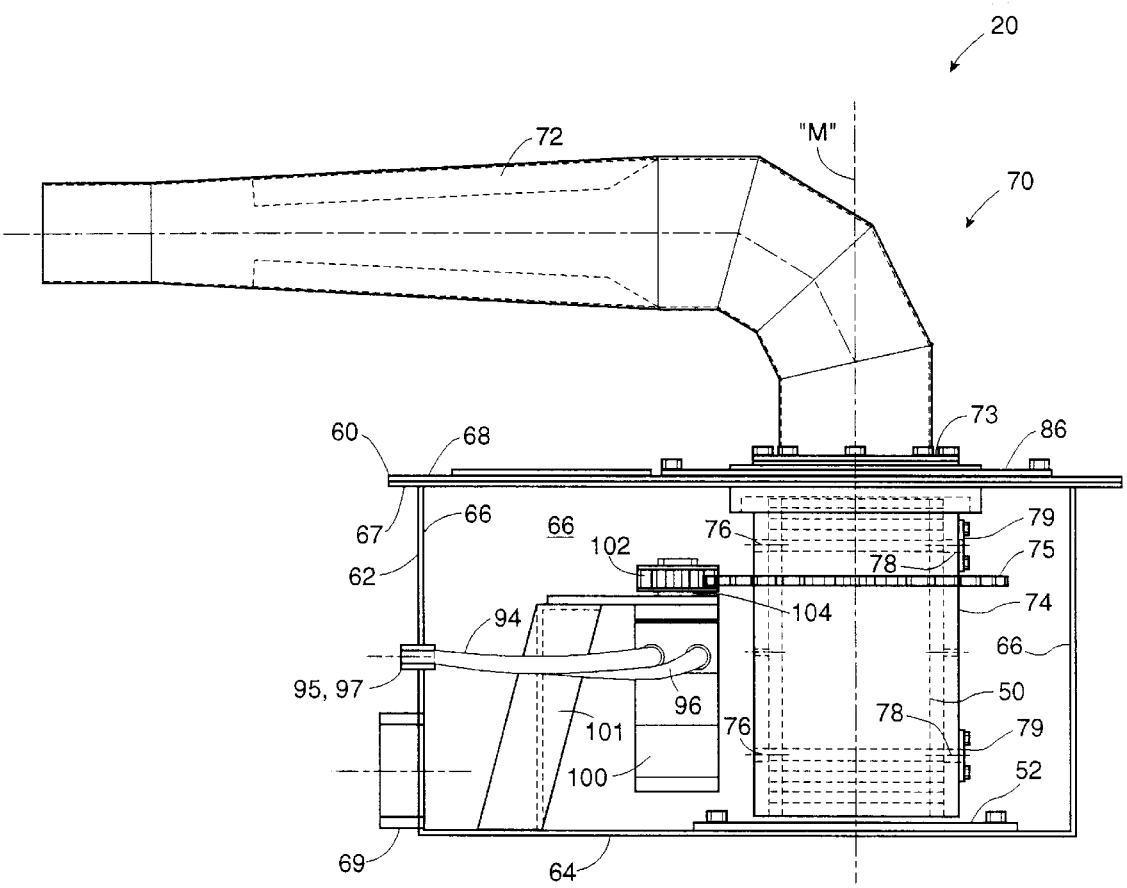
FIG. 3 is an enlarged sectional side elevational view of the slurry agitation apparatus of FIG. 1.

As can be best seen in FIGS. 2 and 3, the spout portion 72 is oriented to emit the slurry 26 from the spout portion 72 as a generally horizontally directed discharge 29 of slurry 26. If desired, the spout portion 72 may be designed and manufactured so as to angled slightly upwardly or downwardly when it is installed in place, in order to discharge slurry 26 over as broad an area as possible, or in a concentrated area, as appropriate. However, spout portion 72 is horizontally directed.

Figure 6:
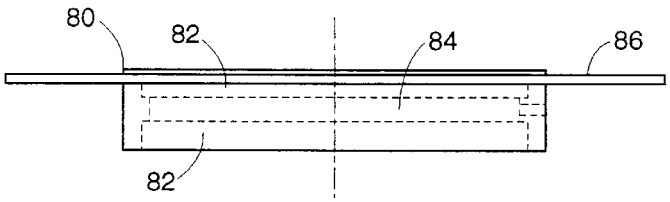
FIG. 6 is a side elevational view of a sealing flange that receives and retains the sleeve portion of FIG. 5.

The sleeve portion 74 of the discharge nozzle 70 and the spout portion 72 of the discharge nozzle 70 are joined at an annular flange portion 73, and rotate together about the vertical main axis "M". In order to seal the discharge nozzle 70 so as to preclude passage of slurry 26 from the interior 24 of the storage tank 22 into the enclosure 60, a seal holder assembly 80, as can be seen in FIG. 6, is secured to the top panel, which seal holder assembly 80 has a pair of pressed-in seals 82, one seal 82 adjacent each of the top and bottom of the seal holder assembly 80. A grease filled cavity 84 is disposed in between the two seals 82. The pressed-in seals 82 bear against the outer surface 71 of the sleeve portion 74 of the discharge nozzle 70. The seal holder assembly 80 is secured to the top panel 68 at its flange 86.

The slurry agitation apparatus 20 of the present invention also comprises a hydraulic circuit, as indicated by the general reference numeral 90, having various components connected together in seriatim, and in fluid communication one with the next through various pipes in the hydraulic circuit 90, which pipes are substantially buried in the concrete foundation 28, as will be discussed in greater detail subsequently. The hydraulic circuit 90 includes a selectively controllable hydraulic pump means 92, preferably, but not necessarily, a bi-directional hydraulic pump 92, which may be driven by an electric motor 92*m,* or, in an agricultural setting, by a suitably connected tractor (not shown), or by any other suitable means. The hydraulic pump 92 is connected in fluid communication by a hydraulic supply line 94 and a hydraulic return line 96, both of which are disposed in passageways 27 in the concrete foundation 28, and pass through respective couplings 95,97 in the bottom receptacle 62 of the enclosure 60, to a selectively operable motor means 100 mounted within the enclosure 60 on a mounting bracket 101 secured to the bottom panel 64 of the enclosure 60. The selectively operably hydraulic motor means 100 is preferably, but not necessarily, a bi-directional hydraulic motor 100.

The pump house 21 is preferably located as close to the storage tank 22 as possible, so as to minimize the lengths of the slurry supply line 47, the slurry return line 46, the hydraulic supply line 94, and the hydraulic return line 96.

As can best be seen in FIG. 3, the hydraulic motor 100 has a drive gear 102 mounted on a drive shaft 104. The drive gear meshes with the peripherally disposed annular sprocket 75 on the discharge nozzle 70 to permit the hydraulic motor means to engage in driving relation with the discharge nozzle 70, to cause the selective rotation of the discharge nozzle 70 about its substantially vertical main axis "M" when slurry 26 is being discharged from the spout portion 72 of the discharge nozzle 70, thereby causing corresponding change in the horizontal direction of the discharge 29 of slurry 26.

Generally, slurry agitation apparatus in keeping with the present invention is used or is intended to be used in an industrial setting, as opposed to a farm setting. For example, the chemical industry, meat and poultry processing plants, abattoirs, tanneries, canning plants, soap making factories, as well as municipal sewage disposal operations, and many others, may all have slurry storage facilities. If so, sludge will settle, in time, giving rise to the necessity for slurry agitation. However, it may well be that decisions are made to rotate the nozzle so as to maintain slurry agitation, even thought the pump is not operating and no slurry discharge operation is taking place. As noted above, by rotating the nozzle, the slurry in the surrounding vicinity will maintain a generally liquified state; and, if the nozzle is rotated periodically, it will then be more assured to be free to rotate even though the slurry is beginning to harden.

Moreover, some circumstances will arise when a decision is made that the discharge nozzle will not be rotated for a period of time, even when a discharge operation is being conducted. Such decisions may readily be made by a skilled operator and are dependent, at least in part, on the nature of the slurry being stored in the slurry tank, and the number and layout of the slurry agitation apparatuses as taught herein which are installed in any one particular slurry tank.

There may, indeed, be one, two, or more discrete slurry agitation apparatuses 20, installed in any particular slurry tank. Those decisions are made as the apparatus is being installed into the tank, or indeed as the tank is being built, and are dependent upon the slurry material to be stored in the storage tank 22, as well as the size of the storage tank 22.

In use, the slurry 26 in the storage tank 22 is drawn through the outlet 42 and the pipes 46 and 49 to the slurry pump 48. The slurry 26 is pumped by the slurry pump 48 through the slurry supply line 47 and the substantially vertical spigot 50, and out the discharge nozzle 70. The hydraulic motor 100 rotates the discharge nozzle 70, as described above. In the event that the slurry 26 that is adjacent the outlet 42 has congealed or coagulated enough that it will not flow, the slurry pump 48 may be reversed to take in slurry through the discharge nozzle 70, or alternatively through auxiliary inlets (not shown) disposed in the side of the storage tank 22, and discharge the slurry 26 through the outlet 42.

Finally, it is clear that operation of the slurry pump 48, and operation of the hydraulic motor 100 to rotate the discharge nozzle 70, are quite independent of one another. The slurry pump can be operated without the discharge nozzle 70 being selectively rotated; and the discharge nozzle 70 may be selectively rotated without the necessity for the slurry pump to be operating. Moreover, there may be occasions when it is required or desired that the discharge nozzle 70 shall not be rotating, even though the slurry pump 48 is operating. All of these various operating circumstances are readily selectable, by operation of appropriate switches and controls on a control panel (not shown), which may be conveniently installed in the pump house 21.

Other modifications and alterations may be used in the design and manufacture of the apparatus of the present invention without departing from the spirit and scope of the accompanying claims.

What is claimed is:

1. A slurry agitation apparatus for selectively agitating slurry temporarily stored in the interior of a storage tank having a concrete foundation forming a floor and a perimeter wall disposed around said concrete foundation and extending upwardly from said concrete foundation, said concrete foundation and said perimeter wall together forming an interior for receiving and retaining slurry therein; wherein a sump pit is disposed in said concrete foundation and is open to said floor; and wherein said slurry contains heavier-than-liquid solids suspended therein, and is at least somewhat pumpable; said slurry agitation apparatus comprising:

a slurry circuit having connected together in seriatim, and in fluid communication through pipes one with the next: an outlet disposed in said sump pit in fluid communication with the interior of the storage tank to permit egress of said slurry therefrom; flow control valve means; selectively controllable slurry pump means; and a discharge nozzle rotatably mounted in surrounding sealed relation on a substantially vertical spigot securely mounted on said concrete foundation of said storage tank, for selective rotation of said discharge nozzle about a substantially vertical main axis, and having a spout portion in fluid communication with the interior of said storage tank and oriented to emit said slurry from said spout portion as a generally horizontally directed discharge; and a hydraulic circuit having connected together in seriatim, and in fluid communication through hydraulic piping one with the next: selectively controllable hydraulic pump means; and selectively operable hydraulic motor means mounted within an enclosure located in said storage tank on said foundation, so as to be engaged in driving relation with said discharge nozzle to cause said selective rotation of said discharge nozzle about said substantially vertical main axis.

2. The slurry agitation apparatus of claim 1, wherein selective rotation of said discharge nozzle, and selective control of said hydraulic pump means, are independent one of the other; whereby either or both of the selective operations may be operable at any given time.

3. The slurry agitation apparatus of claim 1, wherein said selectively operable hydraulic motor means causes said selective rotation of said discharge nozzle about said substantially vertical main axis when slurry is being discharged from said discharge nozzle, thereby causing corresponding change in the horizontal direction of said discharge of slurry.

4. The slurry agitation apparatus of claim 3, wherein a lower portion of said discharge nozzle is disposed within said enclosure.

5. The slurry agitation apparatus of claim 4, wherein said spigot is disposed within said enclosure.

6. The slurry agitation apparatus of claim 3, further comprising an equipment retaining pit, and wherein said enclosure is disposed in said equipment retaining pit.

7. The slurry agitation apparatus of claim 3, wherein said enclosure comprises an open-top bottom receptacle having a bottom panel and a four adjoined side panels extending upwardly from said bottom panel to terminate in a substantially horizontally oriented planar flange, and a top panel removably secured to said substantially horizontally oriented planar flange.

8. The slurry agitation apparatus of claim 7, wherein said planar flange of said enclosure is secured to said concrete foundation.

9. The slurry agitation apparatus of claim 8, wherein said pipes in said slurry circuit are substantially buried in said concrete foundation.

10. The slurry agitation apparatus of claim 1, wherein said pipes and piping in said hydraulic circuit are substantially buried in said concrete foundation.

11. The slurry agitation apparatus of claim 1, wherein said spigot includes an annular base flange and is mounted on said concrete foundation by means of said enclosure.

12. The slurry agitation apparatus of claim 1, wherein said spigot includes a pair of annular "O"-ring grooves cut in its outer surface, disposed one adjacent each of its upper and lower ends, with a co-operating "O"-ring seated in each "O"-ring groove.

13. The slurry agitation apparatus of claim 12, wherein said spigot includes a pair of annular ball bearing races cut in its outer surface, disposed one adjacent each of its upper and lower ends, with a plurality of ball bearings seated in each ball bearing race.

14. The slurry agitation apparatus of claim 13, wherein said discharge nozzle includes a sleeve portion which surrounds said substantially vertical spigot.

15. The slurry agitation apparatus of claim 14, wherein said sleeve portion of said discharge nozzle includes a pair of annular ball bearing races cut in its inner surface, disposed one adjacent each of its upper and lower ends, each ball bearing race in said sleeve portion being vertically aligned with a corresponding ball bearing race in said spigot, thereby to receive a corresponding one of said pluralities of ball bearings seated in each ball bearing race.

16. The slurry agitation apparatus of claim 1, wherein said hydraulic motor means includes a drive gear and said discharge nozzle includes a peripherally disposed annular gear, which drive gear and annular gear mesh one with the other to permit said hydraulic motor means to be engaged in said driving relation with said discharge nozzle.

17. The slurry agitation apparatus of claim 1, wherein said spout portion of said discharge nozzle is oriented substantially horizontally.

18. The slurry agitation apparatus of claim 1, wherein said selectively controllable slurry pump means is disposed in a pump house exterior to said storage tank.

19. The slurry agitation apparatus of claim 1, wherein said flow control valve means is disposed in a pump house exterior to said storage tank.

20. The slurry agitation apparatus of claim 1, wherein said selectively controllable hydraulic pump means and said selectively operable hydraulic motor means are bi-directional.

* * * * *